US006405776B1

(12) United States Patent
Rauch

(10) Patent No.: US 6,405,776 B1
(45) Date of Patent: Jun. 18, 2002

(54) HOOP-CASING DEVICE

(75) Inventor: Manfred Rauch, Sasbach (DE)

(73) Assignee: Fromm Holding AG, Steinhausen (CH)

( * ) Notice: Subject to any disclaimer, the term of this patent is extended or adjusted under 35 U.S.C. 154(b) by 0 days.

(21) Appl. No.: 09/423,039

(22) PCT Filed: Apr. 9, 1999

(86) PCT No.: PCT/OH98/00137

§ 371 (c)(1),
(2), (4) Date: Oct. 29, 1999

(87) PCT Pub. No.: WO98/51569

PCT Pub. Date: Nov. 19, 1998

(30) Foreign Application Priority Data

May 13, 1997 (CH) ..... 97 1119

(51) Int. Cl.[7] ..... B65B 13/32; B29C 65/06

(52) U.S. Cl. ..... 156/391; 156/494; 156/580; 100/29; 100/32; 140/93.4

(58) Field of Search ..... 156/391, 502, 156/576, 580, 579, 359, 358; 140/93.4, 93.2; 100/29, 30, 32, 33 PB

(56) References Cited

U.S. PATENT DOCUMENTS 3,360,017 A * 12/1967 Vilcins ..... 140/93.4
3,442,732 A * 5/1969 Stensaker et al. ..... 156/73.5
3,586,572 A * 6/1971 Ericsson ..... 156/359
4,015,643 A * 4/1977 Cheung ..... 140/93.4
4,313,779 A * 2/1982 Nix ..... 156/361
5,133,532 A * 7/1992 Figiel et al. ..... 254/216
5,542,239 A * 8/1996 Fujii et al. ..... 53/477
5,632,851 A * 5/1997 Young ..... 156/494

* cited by examiner

*Primary Examiner*—Richard Crispino
*Assistant Examiner*—Sue A. Purvis
(74) *Attorney, Agent, or Firm*—George Pappas

(57) ABSTRACT

The invention relates to a hoop-casing device (2) for hooping an object with a heat-sealable plastic strip (3) placed around it, comprising a unit (2) for stressing the strip (3) and for friction-sealing two overlapping strip parts (4, 5). Said unit (2) comprises a tool part which rotates around a rotational axis (6) and can be driven, with a cylindrical tool cover surface (8) and a bearing part (9), said bearing part having a bearing surface (10) facing towards the tool part (7). At least said bearing surface (10) has a structure similar to toothing. The tool part (7) and the bearing part (9) pivot mutually around a swivel axis (12) which is parallel to the rotational axis (6). The bearing part (9) comprises a multi-part shoe (13) consisting of several holding blocks (14, 16, 18) arranged together angularly around the rotational axis (6). Said holding blocks (14, 16, 18) have exterior faces (15, 17, 19) which together form one exterior face (24) of the shoe (13) and the bearing surface (10) of the bearing part (9). The exterior faces (15, 17, 19) of the holding blocks (14, 16, 18) are preferably essentially level and at a right angle to the edges (20, 21, 22, 23) which are parallel to the rotational axis (6) and the swivel axis (12).

2 Claims, 7 Drawing Sheets

HOOP-CASING DEVICE

BACKGROUND

The invention concerns a hoop-casing device for hooping an object with a heat-sealable plastic strip placed around it.

Hoop-casing devices of the type mentioned above are multiply known, for instance from EP-0744342. They comprise a tool part and a counter-bearing part, the counter-bearing surfaces of which face each other and match each other and have a structure similar to a toothing to be able to grip the plastic strip as efficiently as possible during tensioning and friction-sealing.

In this context it is a drawback that it is work-expensive and costly to manufacture the desired structure similar to a toothing on the concave counter-bearing surface of the counter-bearing part.

SUMMARY

The object of the invention is to provide a hoop-casing device of the relevant generic type that does not have the above mentioned drawback.

According to the invention said object is attained in a hoop-casing device of the relevant generic type by providing a hoop-casing device for hooping an object with a heat-sealable plastic strip placed around the object; the hoop-casing device comprising a unit for tensioning the strip and for friction-sealing two overlapping strip parts of the tensioned strip; the unit comprising a tool part that can be rotatably driven about a rotation axis and having a generally cylindrical tool mantle surface, the unit further comprising a counter-bearing part having a counter-bearing surface facing the tool part and extending over a sector of the tool mantle surface and generally enclosing said sector; at least the counter-bearing surface of the counter-bearing part having a structure similar to toothing; the tool part and the counter-bearing part being mutually pivotable about a swivel axis that is parallel to the rotation axis to grip or release the overlapping strip parts between the counter-bearing surface and the tool mantle surface, characterized in that: the counter-bearing part comprises a multipart shoe made up of holding blocks arranged side by side in angular sequence about the rotation axis; and, the holding blocks having respective outer faces which taken together form an outer face of the shoe as well as the counter-bearing surface of the counter-bearing part.

In this embodiment according to the invention the concave counter-bearing surface of the counter-bearing part is composed of several portions of parts that are arranged side by side, namely, composed of the plurality of outer faces of the holding blocks, which in contrast with the prior art allows rather small areas of the concave counter-bearing surface to be machined individually and the machining costs to be correspondingly reduced.

Advantageous embodiments of the hoop-casing device according to the invention include making the outer faces of the holding blocks essentially planar and rectangular with edges parallel to the rotation axis and swivel axis.

More particularly, it is advantageous to provide that the holding blocks each are provided with an essentially planar and rectangular outer face, the edges of this outer face being parallel to the rotation axis and the swivel axis. Such holding blocks can then be machined economically and at the same time structured with an optimal toothing on one planar outer face. Moreover, when being mounted they are adapted to be arranged side by side and fixed on the shoe in such a way that they end up all located on the mantle surface of a prism having edges essentially parallel to the rotation axis and the swivel axis. Taken together, the holding blocks thus manufactured and mounted make up a counter-bearing surface of the counter-bearing part that approximately matches the generally cylindrical tool mantle surface of the tool part, which, in combination with the optimal toothing, allows the overlapping strip parts inserted therebetween to be well gripped and hold and to be applied high tensioning forces.

DESCRIPTION OF THE DRAWINGS

An exemplary embodiment of the invention is explained below with reference to the drawings.

In all figures, parts corresponding to each other are designated with same reference numerals.

DESCRIPTION OF THE PREFERRED EMBODIMENT

Figure 1:
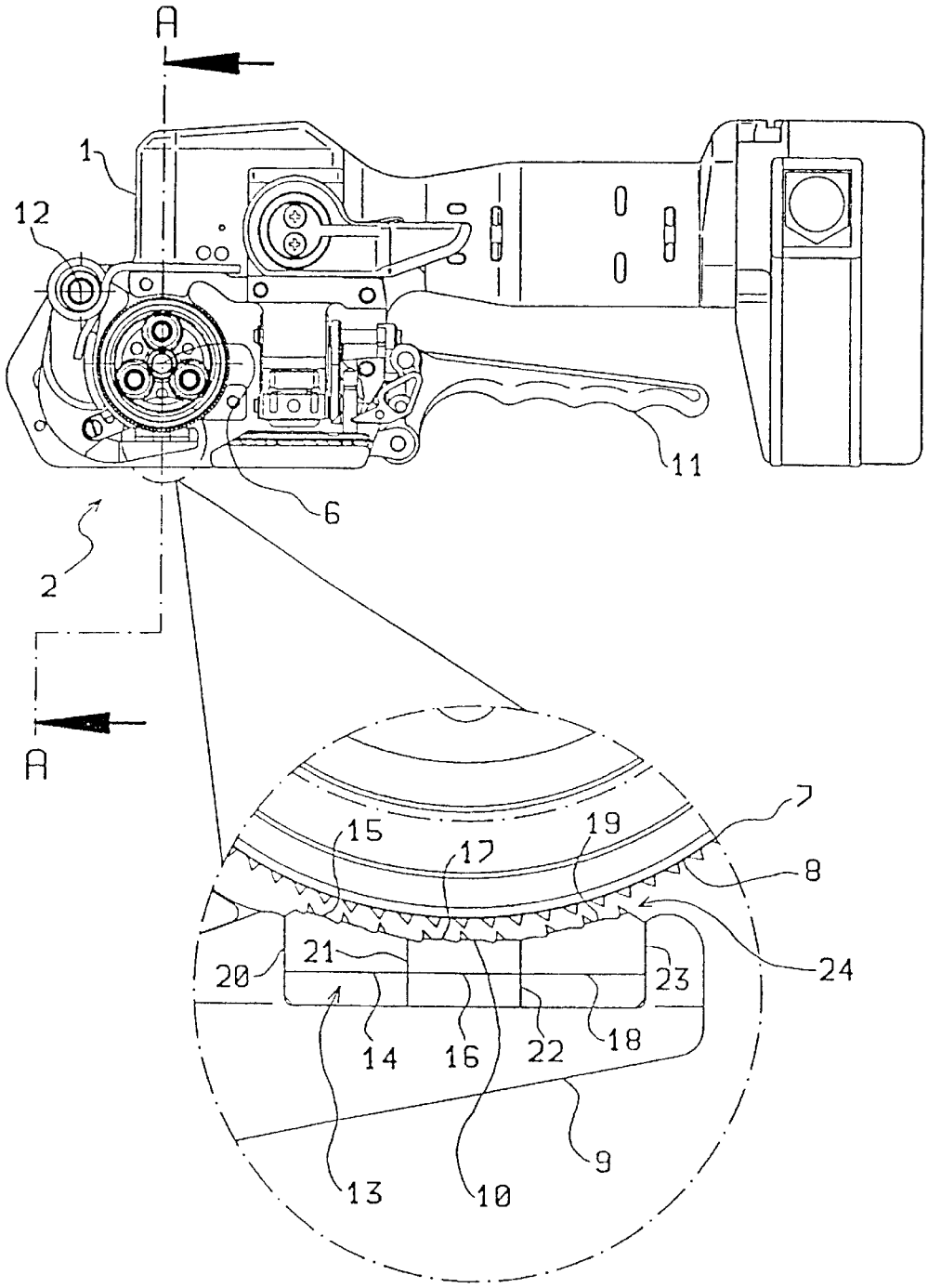
FIG. 1 shows a side view of a hoop-casing device according to the invention together with a view of a partial domain of the hoop-casing device magnified by a factor of about six (magnifying glass view)
Figure 2:
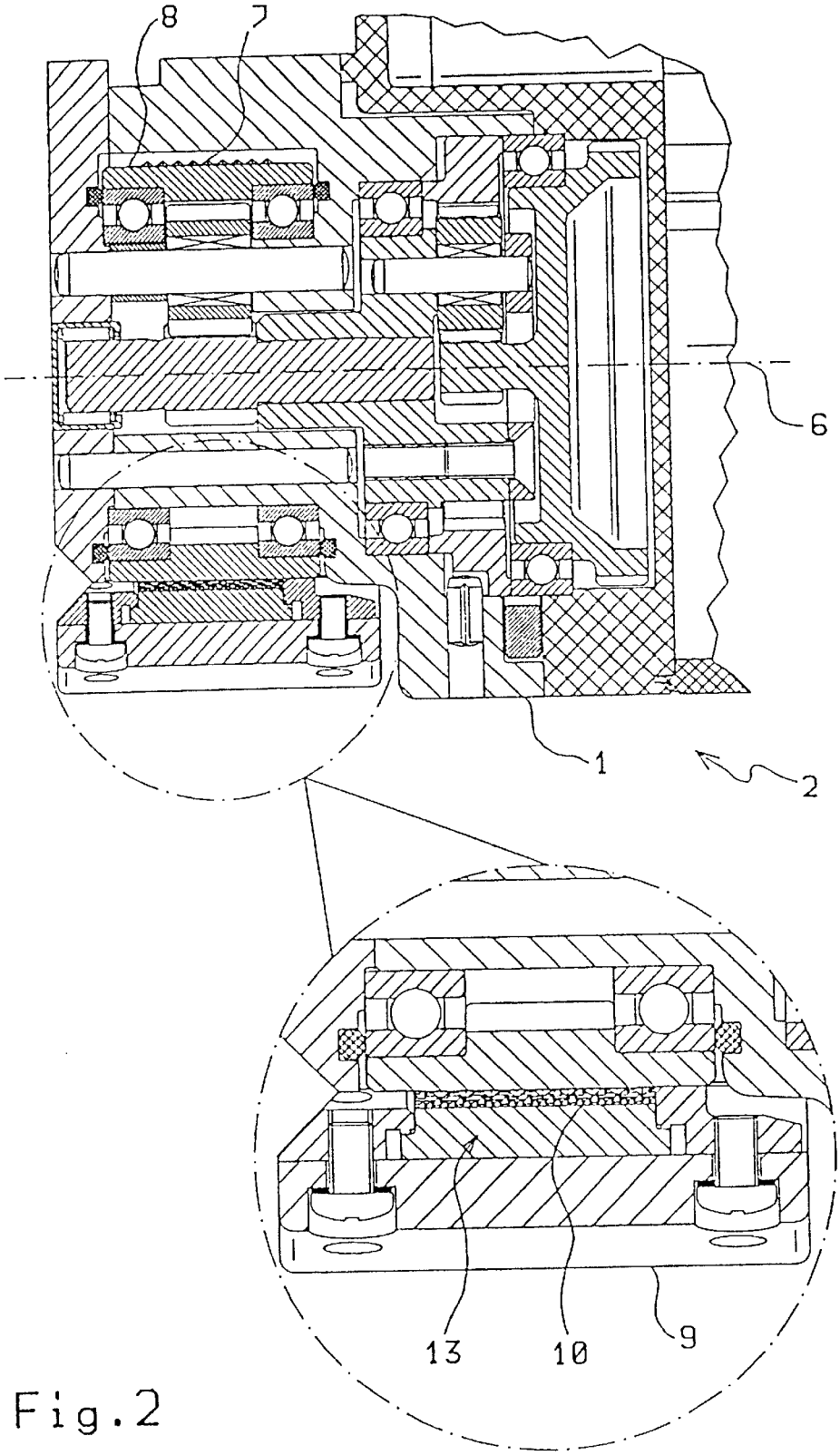
FIG. 2 shows a sectional view of the hoop-casing device cut along line A—A of FIG. 1 together with a view of a partial domain of the hoop-casing device magnified by a factor of about one and a half (magnifying glass view)

The hoop-casing device according to the invention that is illustrated in the figures serves to hoop-case an object with a plastic strip placed around it and will be described with reference to an exemplary embodiment, it being understood that the invention must not be limited to this exemplary embodiment.

The illustrated hoop-casing device comprises, at a housing 1, a unit 2 for tensioning a heat-sealable plastic strip 3 and for friction-sealing two strip parts 4 and 5 of this plastic strip 3 that overlap each other. The unit 2 comprises a tool part 7 that has a generally cylindrical tool mantle surface 8 and that can be rotated about a rotation axis 6 and driven. Additionally, the unit 2 comprises a counter-bearing part 9 that in turn is provided with a counter-bearing surface 10 facing the tool part 7 and extending over a sector of the tool mantle surface and generally enclosing the latter.

The counter-bearing surface 10 and, advantageously, the tool mantle surface 8 as well, are provided with structural features to allow to grip the plastic strip 3 as efficiently as possible. However, whereas the tool mantle surface 8 is conventionally provided with structural features similar to a ratchet toothing, the counter-bearing surface 10 is provided with a special toothing that will be described more in detail below and may best be perceived in FIGS. 3, 4 and 5.

Either and alternatively to grip or release the overlapping strip parts 4 and 5 between the counter-bearing surface 10 and the tool mantle surface 8, the tool part 7 and the counter-bearing part 9 can be swivelled relative to each other about a swivel axis 12 by means of a lever 11, this swivel axis 12 being parallel to the rotation axis 6.

The production of structural features of the counter-bearing surface 10 and the manufacturing of the counter-bearing part 9 are considerably facilitated by the fact that the counter-bearing part 9 comprises a separate shoe 13 that is made up of several parts. In the exemplified embodiment the shoe 13 is composed of three holding blocks 14, 16 and 18 that are arranged side by side in angular sequence about the rotation axis 6. These holding blocks 14, 16 and 18 are provided with respective outer faces 15, 17 and 19 adjacent to each other at edges 20, 21, 22, 23 and that, taken together, form an outer face 24 of the shoe 13 and hence, the counter-bearing surface 10 of the counter-bearing part 9 as well.

In comparison with a conventional type of shoe that is three times larger, it is already easier to machine the three described smaller holding blocks 14, 16 and 18 in order to provide their outer faces with structural features. The manufacture, however, is still further facilitated by the fact that the outer faces 15, 17 and 19 of the holding blocks 14, 16 and 18 are essentially planar and rectangular. Subsequently, to allow to grip the plastic strip as efficiently as possible the edges 20, 21, 22, 23 are disposed parallel to the rotation axis 6 and swivel axis 12, and the outer faces 15, 17 and 19 are located on a prismatic mantle surface that encloses the tool mantle surface 8. The thus formed counter-bearing surface 10 of the counter-bearing part 9 approximately matches the cylindrical tool mantle surface 8 of the tool part 7 and allows the overlapping strip parts 4 and 5 of the plastic strip 3 inserted therebetween to be sufficiently well gripped and hold.

Figure 3:
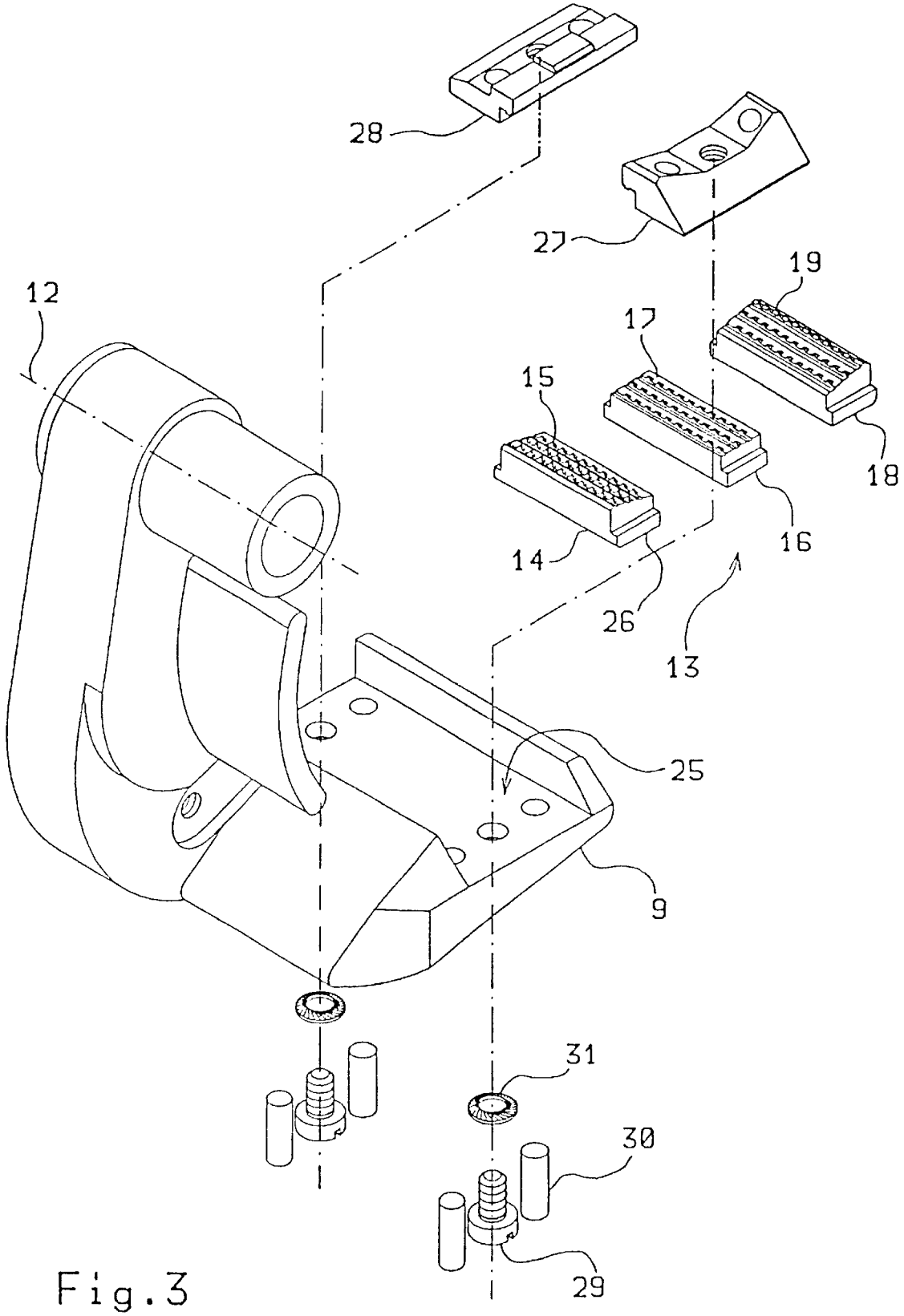
FIG. 3 shows a perspective explosion view of parts of the hoop-casing device in order to illustrate the fixation and arrangement of holding blocks at the hoop-casing device.
Figure 5:
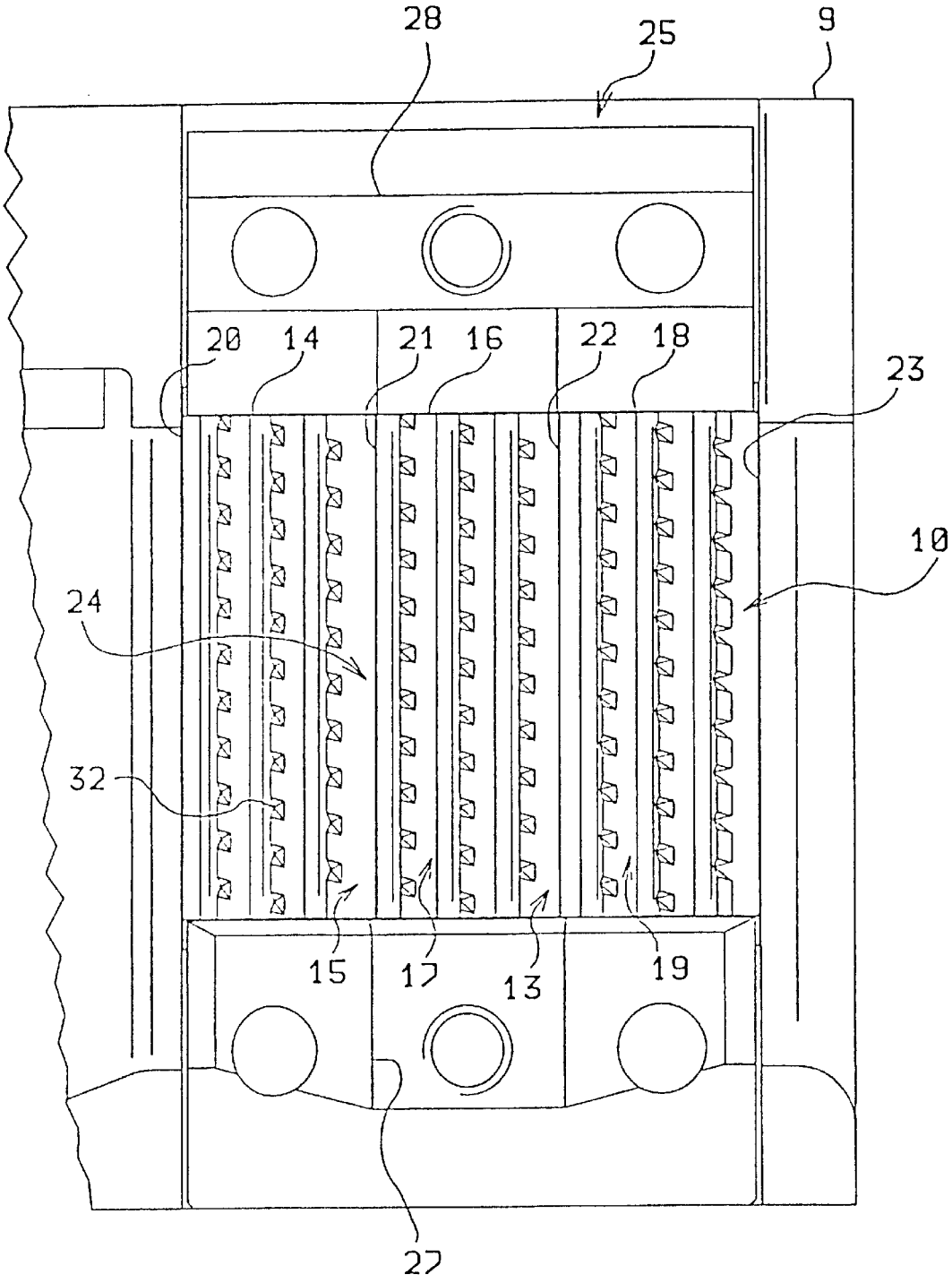
FIG. 5 shows a top view of a part of the hoop-casing device shown in the magnifying glass view of FIG. 1, broken-off and magnified by a factor of about one and a half in comparison with said magnifying glass view, in order to illustrate the structural features and mutual arrangement of the holding blocks.
Figure 6:
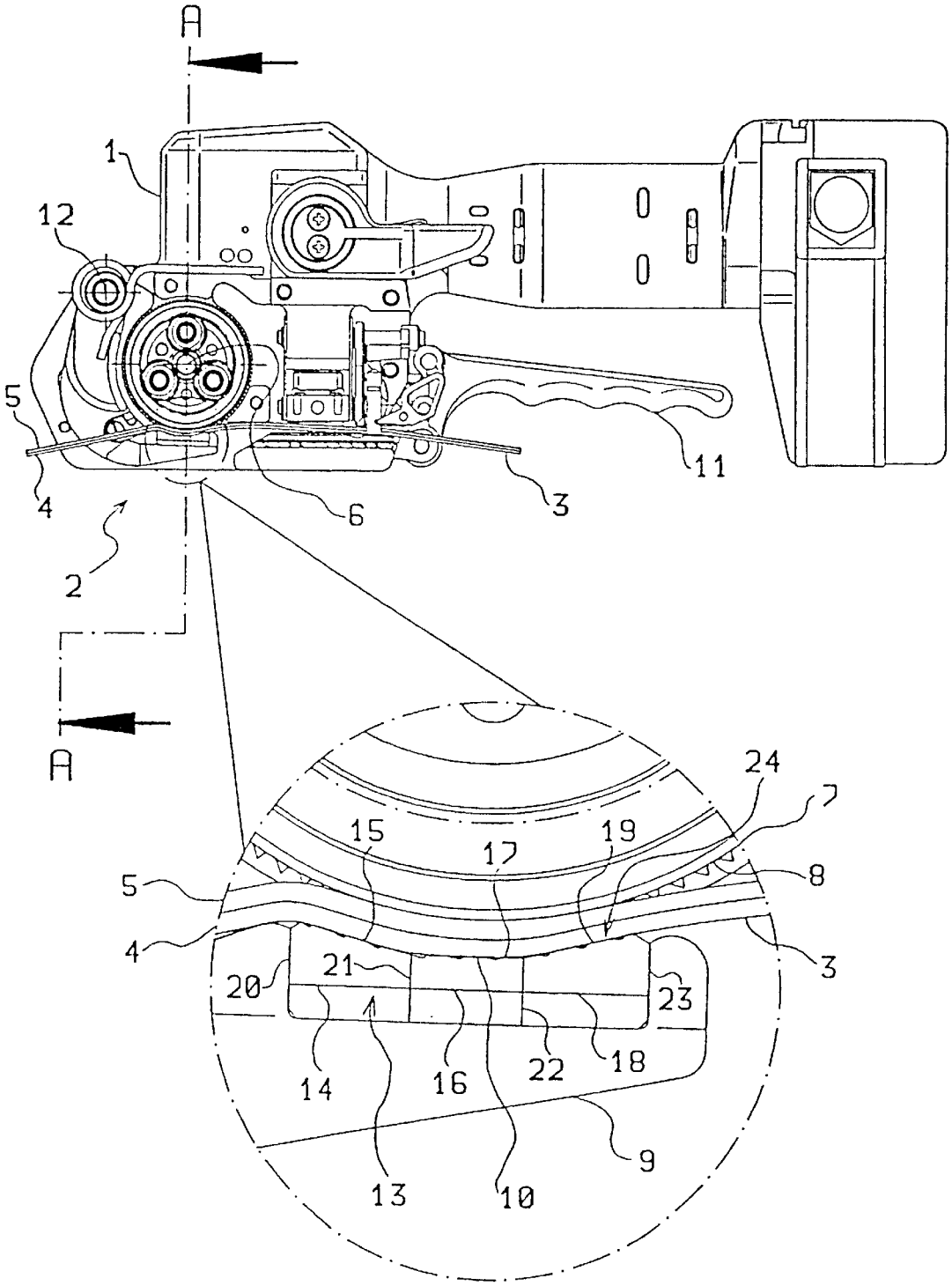
FIG. 6 shows the hoop-casing device in a view that is the same as in FIG. 1 but for the plastic strip being inserted.
Figure 7:
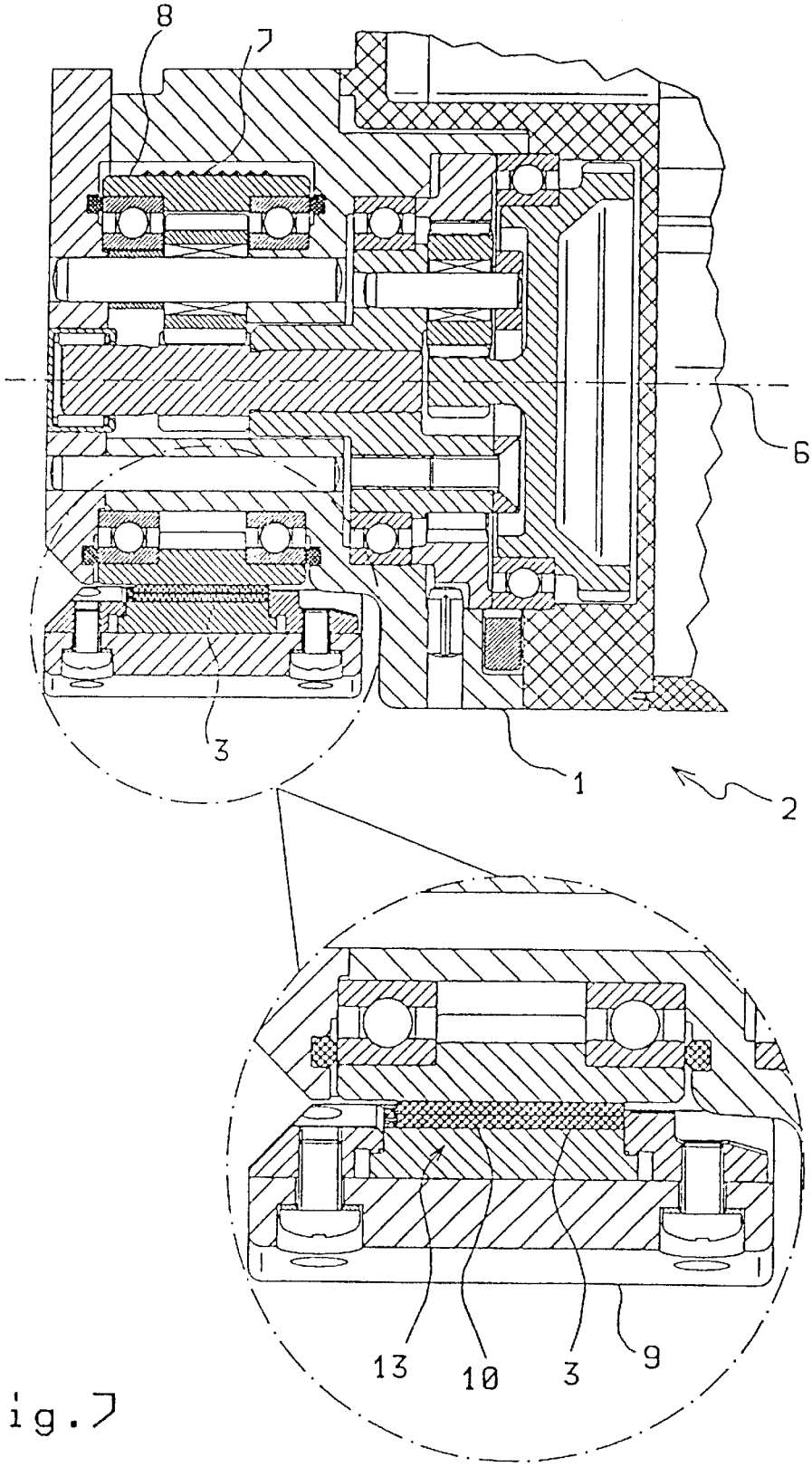
FIG. 7 shows the hoop-casing device in a view that is the same as in FIG. 2 but for the plastic strip being inserted.

How the shoe 13 or the holding blocks 14, 16 and 18, respectively, are fixed on the counter-bearing part 9 may best be perceived in FIGS. 3 and 5. The holding blocks 14, 16 and 18 are located next to each other and resting against each other in a recess 25 of the counter-bearing part 9 with those edges 20, 21, 22, 23 that are parallel to the rotation axis 6 and the swivel axis 12 constituting respective longer edges of the outer faces 15, 17 and 19, which are formed rectangular. In a direction parallel to the rotation axis 6 and the swivel axis 12 the holding blocks 14, 16 and 18 terminate on each side thereof in projections 26, each of which protrudes under one of two clamping blocks 27 and 28. These clamping blocks 27 and 28 are fixed on the counter-bearing part 9 with the help of screws 29, guide pins 30 and washers 31 and in turn hold the holding blocks 14, 16 and 18 when the screws 29 are tightened at the counter-bearing part 9.

Figure 4:
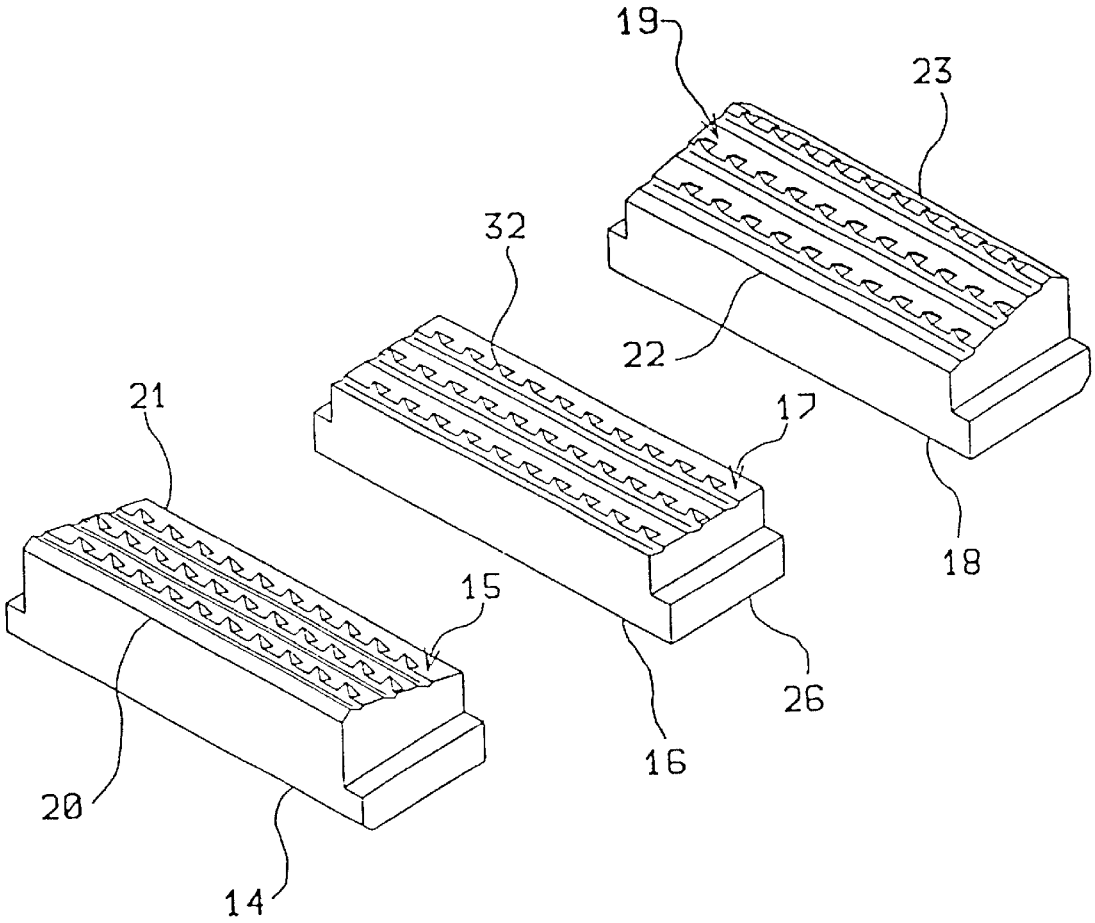
FIG. 4 shows a perspective explosion view of the holding blocks of FIG. 3 magnified by a factor of about two in comparison with FIG. 3.

The machining of the outer faces 15, 17 and 19 of the holding blocks 14, 16 and 18 eventually produces an embodiment with structural features such as for instance that which may best be perceived in FIGS. 3, 4 and 5. The planar outer faces 15, 17 and 19 of the holding blocks 14, 16 and 18 allow and facilitate the machining of the holding blocks by milling or grinding in various directions essentially parallel to the outer faces while oriented at any desired angle to the longer edges 20, 21, 22, 23. In this manner the outer faces 15, 17 and 19 of the holding blocks 14, 16 and 18 are provided with any desired rows and patterns of diamond points 32 that are adapted to be pressed into the strip portion that rests against the counter-bearing part 9 and to hold it well during a clamping of the overlapping strip parts 4 and 5 of the plastic strip 3 between the tool part 7 and the counter-bearing part 9.

What is claimed is:

1. A hoop-casing device for hooping an object with a heat-sealable plastic strip placed around the object;

the hoop-casing device comprising a unit for tensioning the strip and for friction-sealing two overlapping strip parts of the tensioned strip;

the unit comprising a tool part that can be rotatably driven about a rotation axis and having a generally cylindrical tool mantle surface, the unit further comprising a counter-bearing part having a counter-bearing surface facing the tool part and extending over a sector of the tool mantle surface and generally enclosing said sector;

at least the counter-bearing surface of the counter-bearing part having a structure similar to toothing;

the tool part and the counter-bearing part being mutually pivotable about a swivel axis that is parallel to the rotation axis to grip or release the overlapping strip parts between the counter-bearing surface and the tool mantle surface, characterized in that:

the counter-bearing part comprises a multipart shoe made up of holding blocks arranged side by side in angular sequence about the rotation axis; and, the holding blocks having respective outer faces which taken together form an outer face of the shoe as well as the counter-bearing surface of the counter-bearing part.

2. The hoop-casing device according to claim 1, characterized in that the outer faces of the holding blocks are essentially planar and rectangular with edges parallel to the rotation axis and swivel axis.

* * * * *